US012466610B2

(12) United States Patent
Rensing

(10) Patent No.: US 12,466,610 B2
(45) Date of Patent: Nov. 11, 2025

(54) CONTAINER WITH SEPARATING WALL

(71) Applicant: GEORG UTZ HOLDING AG, Bremgarten (CH)

(72) Inventor: Sven Rensing, Schüttdorf (DE)

(73) Assignee: GEORG UTZ HOLDING AG, Bremgarten (CH)

( * ) Notice: Subject to any disclaimer, the term of this patent is extended or adjusted under 35 U.S.C. 154(b) by 0 days.

(21) Appl. No.: 17/915,543

(22) PCT Filed: Mar. 24, 2021

(86) PCT No.: PCT/IB2021/052434
§ 371 (c)(1),
(2) Date: Sep. 29, 2022

(87) PCT Pub. No.: WO2021/198854
PCT Pub. Date: Oct. 7, 2021

(65) Prior Publication Data

US 2023/0118080 A1 Apr. 20, 2023

(30) Foreign Application Priority Data

Apr. 1, 2020 (CH) ..... 00392/20

(51) Int. Cl.
*B65D 25/06* (2006.01)

(52) U.S. Cl.
CPC ..... *B65D 25/06* (2013.01)

(58) Field of Classification Search
CPC ..... B65D 25/02; B65D 25/04; B65D 25/06; B65D 25/10; B65D 25/107; B65D 2501/24171
See application file for complete search history.

(56) References Cited

U.S. PATENT DOCUMENTS 3,055,531 A * 9/1962 De Chelbor ..... B65D 25/00 220/4.01
3,784,051 A * 1/1974 Shaw ..... B65D 25/06 220/580

(Continued)

FOREIGN PATENT DOCUMENTS

CH 709158 A2 7/2015
EP 0429015 A1 5/1991

(Continued)

OTHER PUBLICATIONS

International Search Report mailed on Jun. 28, 2021, in connection with corresponding International Application No. PCT?IB2021/052434 (6 pp., including machine-generated English translation).

*Primary Examiner* — Andrew T Kirsch
(74) *Attorney, Agent, or Firm* — Greer, Burns & Crain, Ltd

(57) ABSTRACT

The invention relates to a container (1) with a base (2) and lateral walls (3, 4) which lie opposite each other, said container having a separating wall (6) for the purpose of dividing the interior of the container (1). The lateral edges (6*a*) of the separating wall (6) are provided with protruding contoured sections (7) which can be inserted into grooves (5) in the lateral walls (3) in a formfitting manner. According to the invention, each of the protruding contoured sections (7) has an elastic protrusion (10) on the contour lower end, said elastic protrusion extending outwards at an angle to the lateral edge (6*a*) of the separating wall (6). The elastic protrusions (10) are used as an installation aid when inserting the separating wall (6) into the grooves (5) in that the grooves (5) are easier to reach, in particular in the case of containers with lateral walls which curve outwards at the (Continued)

upper edges due to fatigue, wherein the elastic protrusions (10) yield upon inserting the separating wall (6) downwards into the grooves (5).

10 Claims, 7 Drawing Sheets

(56) References Cited

U.S. PATENT DOCUMENTS

| | | | | |
|---|---|---|---|---|
| 4,499,997 | A | 2/1985 | Swingley, Jr. | |
| 4,577,773 | A * | 3/1986 | Bitel | B25H 3/02 206/561 |
| 2016/0325885 | A1 | 11/2016 | Plattner | |

FOREIGN PATENT DOCUMENTS

| | | | |
|---|---|---|---|
| EP | 1845024 | A1 | 10/2007 |
| JP | 2002264946 | A | 9/2002 |
| JP | 2019001513 | A | 1/2019 |

* cited by examiner

CONTAINER WITH SEPARATING WALL

This application is a National Stage application of International Patent Application No. PCT/IB2021/052434, filed Mar. 24, 2021, which claims the priority of Swiss patent application 00392/20, filed Apr. 1, 2020, the disclosure of each of which is incorporated herein by reference in its entirety.

TECHNICAL FIELD

The invention relates to a container for transporting and storing goods. In particular, it relates to such a container with separating walls which can be inserted into the interior of the container in order to divide it.

BACKGROUND OF THE INVENTION

Containers with insertable separating walls for subdividing the interior are known.

CH 709 158, for example, discloses a plastic container with separating walls for subdividing the container into sections which are inserted into grooves in the lateral walls by means of contours on their end faces and pushed down until they rest against the base of the container. The contours on the end faces of the lateral walls are each formed to match the shape of the associated groove so that they can be inserted therein in a form-fitting manner and held in a stable manner. For this purpose, the contour has a dovetail shape, with its outermost side being straight, i.e. its outermost side runs parallel to the vertical lateral wall of the container.

EP 0 429 015 discloses a container with insertable separating walls which likewise have a contour at their lateral end faces which is inserted into a correspondingly shaped groove in the lateral walls of the container. The contour at the end face has at its lower end an outwardly directed protrusion which, upon inserting the lateral wall into the groove, engages in a corresponding recess in the lateral wall of the container, thereby securing the separating wall.

SUMMARY

According to the present invention, there is disclosed a container with a base and lateral walls extending from the base perpendicular to an upper edge. The container also has one or more separating walls which serve to divide the interior of the container. For this purpose, the lateral walls have grooves extending perpendicularly on their inner sides, each groove extending from the upper edge of a lateral wall toward the base of the container. The one or more separating walls are each provided at two opposite lateral edges with a contour which in each case protrudes from the lateral edge of the separating walls and is adapted to the shape of the grooves in the lateral walls. The one or more separating walls are each insertable by means of the protruding contours at their two lateral edges into the grooves of opposing lateral walls in a form-fit connection, whereby the volume of the container can be subdivided.

According to the invention, the protruding contours at the two lateral edges of the one or more separating walls each have at their lower end an elastic protrusion with a finger shape which extends outwardly away from the protruding contour at a predetermined angle to the plane of the lateral edge of the separating wall.

The protrusions with a finger shape obliquely leading away from the lateral edge of the separating wall at an angle at the lower end of the contours are in the form of a free rib.

They serve as an installation aid when inserting the separating wall into the grooves of the container. The protrusions on the contours obliquely leading away at an angle according to the invention cause a slight increase in the width of the separating walls, namely in the region which is inserted into the grooves. When placing separating walls into a container, the protrusions allow the grooves to be grasped more easily and quickly. The protrusions thus are used as an installation aid. The installation aid in the form of the protrusions according to the invention on the lateral edges of the separating walls are particularly helpful when a container has been deformed due to fatigue of the material or due to frequent and/or excessive filling in that the lateral walls are slightly curved outwards towards the upper edge in their upper half and curved inwards towards the base in their lower portion. The insertion of conventional separating walls in containers deformed in this way is thus made more difficult because the distance between the upper edges of the lateral walls is increased compared with non-curved containers. Conventional separating walls are then smaller than the distance between the lateral walls, and it is more difficult to meet the grooves with the separating walls and to insert the contours into the grooves. Thus, the insertion of conventional separating walls into the grooves requires more time. This is the case in particular, but not only, with containers made of plastic.

In contrast, in a container according to the invention having separating walls with protrusions according to the invention, insertion of the separating walls into grooves in the lateral walls is facilitated, in particular even in cases when the lateral walls are curved.

The protrusions according to the invention on the lateral edges of a separating wall have elastic properties due to their extent obliquely at an angle from the lateral edge of the separating wall. When the separating wall is inserted into the grooves of the lateral walls, the protrusions on the lateral edges first reach the upper end of the grooves at the upper edge of the lateral walls. As the separating wall, i.e. the protruding contours on the lateral edges are inserted deeper into the groove, the protrusions yield thanks to their elastic properties and bend according to the shape of the groove. This is the case when the lateral walls are curved outwards as well as inwards.

In the case of inwardly curved lateral walls, when using conventional separating walls, the separating walls would be too wide, i.e. they are wider than the distance between opposite lateral walls. When inserted into the grooves, the entire separating walls would then bend across their width and become curved. In contrast, in the case of a container having separating walls with the elastic protrusions according to the invention, bending is avoided by allowing the elastic protrusions to yield.

In one embodiment, the protruding contours on the lateral edges of the separating walls additionally have a recess at their lower end in the region of the protrusions, which recess extends towards the upper edge of the separating wall. This enhances the elastic property of the obliquely projecting protrusions. Insertion of the protruding contours with the angled protrusion is thus facilitated and the protrusions can be inserted frequently without fatigue.

In a preferred embodiment of the invention, the elastic protrusions with the finger shape each have an inner side facing toward the lateral edge and each have an outer side facing away from the lateral edge. In this case, the angle between the lateral edge and the inner side of the elastic protrusions is greater than the angle between the lateral edge and the outer side of the elastic protrusions. As such, the protrusions are slightly pointed. This shape further enhances the elastic property of the protrusions.

In a preferred embodiment, the inner side of the protrusions facing the lateral edge of the separating wall extends at an inner angle from the lateral edge of the separating wall, and the outer side of the protrusions facing away from the lateral edge of the separating wall extends at an outer angle away from the lateral edge of the separating wall, the inner angle being greater than the outer angle.

In a preferred embodiment, the inner angle is 15° and the outer angle is 10°.

In another embodiment of the invention, the tip of the elastic protrusions is beveled or rounded. This serves to make it even easier to insert the protrusions into the grooves without hitting anything and without damaging the grooves.

In suitable exemplary embodiments, the protruding contours on the lateral edges of the separating walls are each T-shaped in that they protrude laterally from the lateral edges both outwardly and from the plane of the separating wall on both sides.

BRIEF DESCRIPTION OF THE DRAWINGS

In the figures, the same reference signs have been used for the same elements in each case, and first-time explanations apply to all figures unless expressly stated otherwise. The contours on the lateral edges of the separating walls are formed the same for both separating walls shown.

DESCRIPTION OF THE PREFERRED EMBODIMENTS

Figure 1:
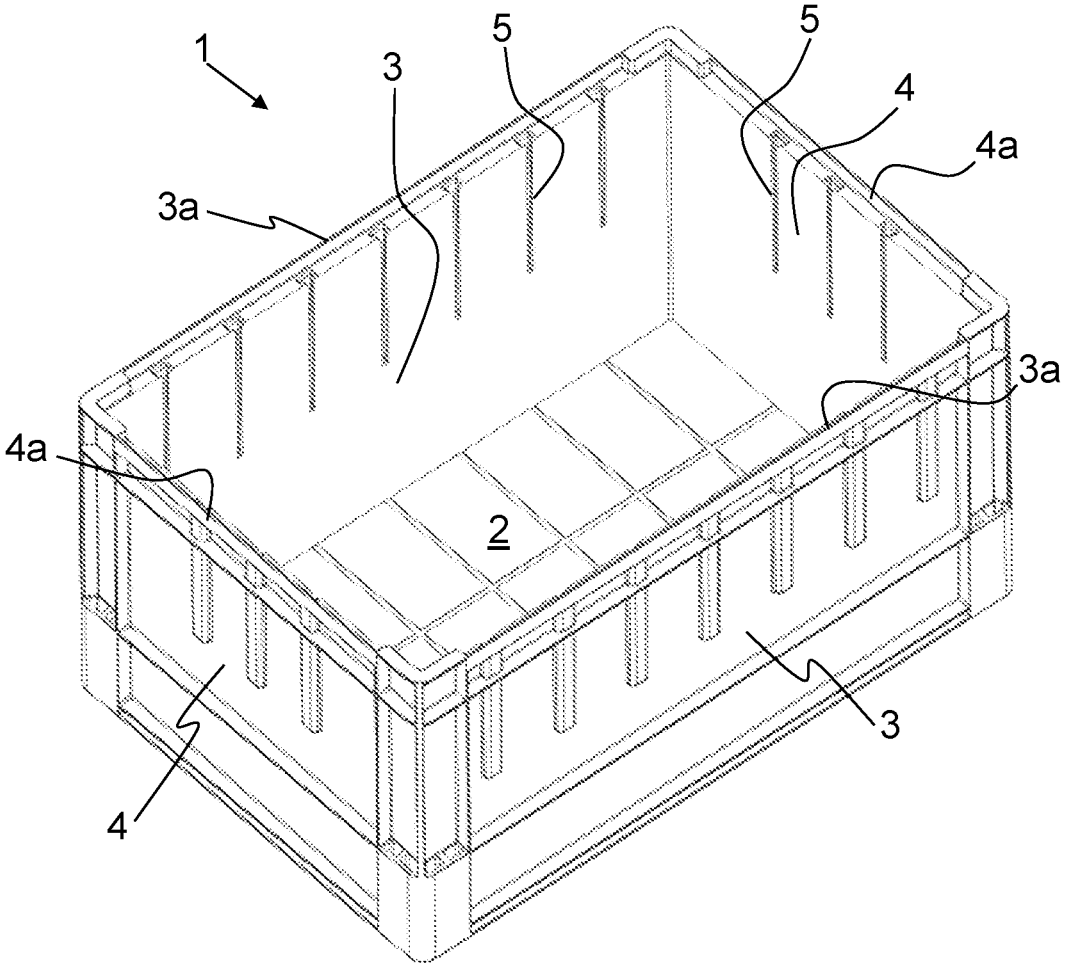
FIG. 1 shows a container according to the invention in a perspective view.
Figure 2:
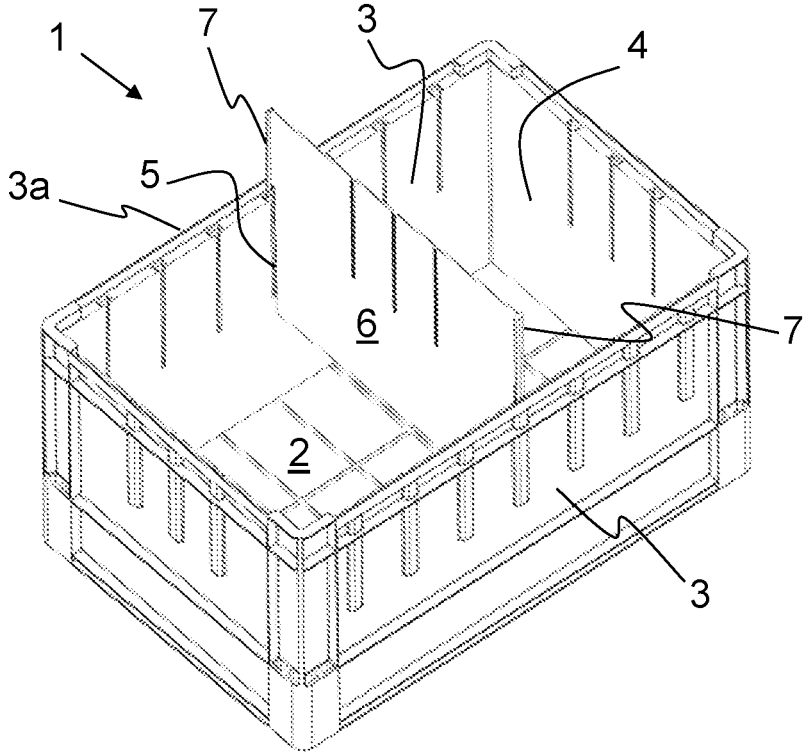
FIG. 2 shows the container of FIG. 1 with a first, partially inserted separating wall with a contour according to the invention on the lateral edge.
Figure 3:
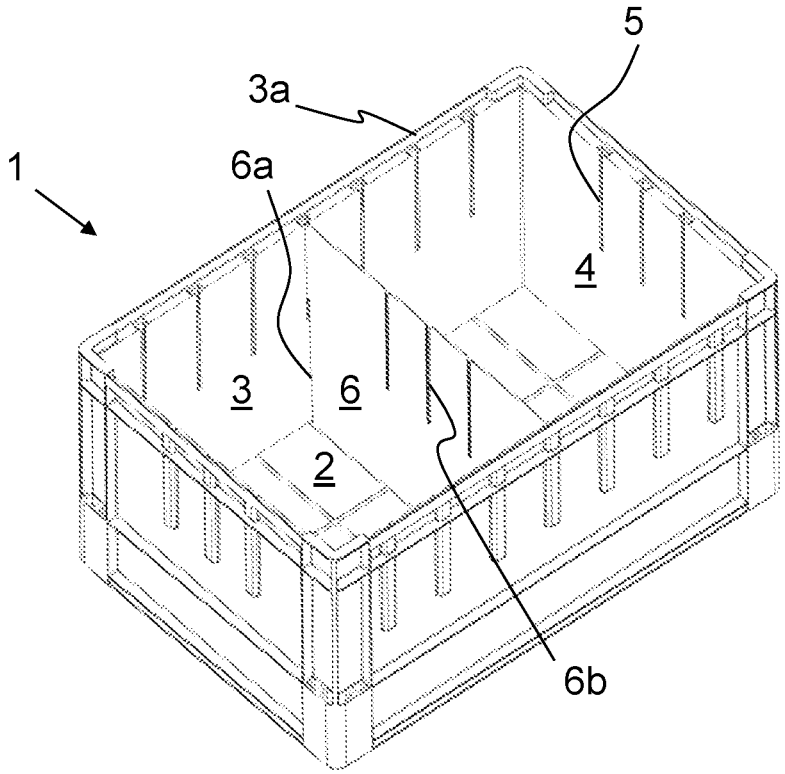
FIG. 3 shows the container of FIGS. 1 and 2 with a fully inserted separating wall.

FIG. 1 shows a container 1 with a base 2 and first lateral walls 3 protruding perpendicularly upwards from the base and facing each other and second lateral walls 4 again facing each other. The lateral walls 3 and 4 are provided with grooves 5 each having an undercut extending perpendicularly from their upper edges 3*a* and 4*a*, respectively, in the direction of the base 2. FIGS. 2 and 3 show the container 1 with a first separating wall 6 which is inserted into the container at a right angle to the long lateral wall 3. For this purpose, the separating wall 6 has a protruding T-shaped contour 7 on each of its two lateral edges 6*a*, which contours extend substantially parallel to the lateral edges 6*a*, as shown in FIG. 2. The T-shaped contours 7 on the lateral edges 6*a* are formed with an undercut corresponding to the shape of the groove 5 and can be inserted into the groove 5 in a form-fitting manner until the separating wall 6 reaches the base 2, as shown in FIG. 3.

Figure 4A:
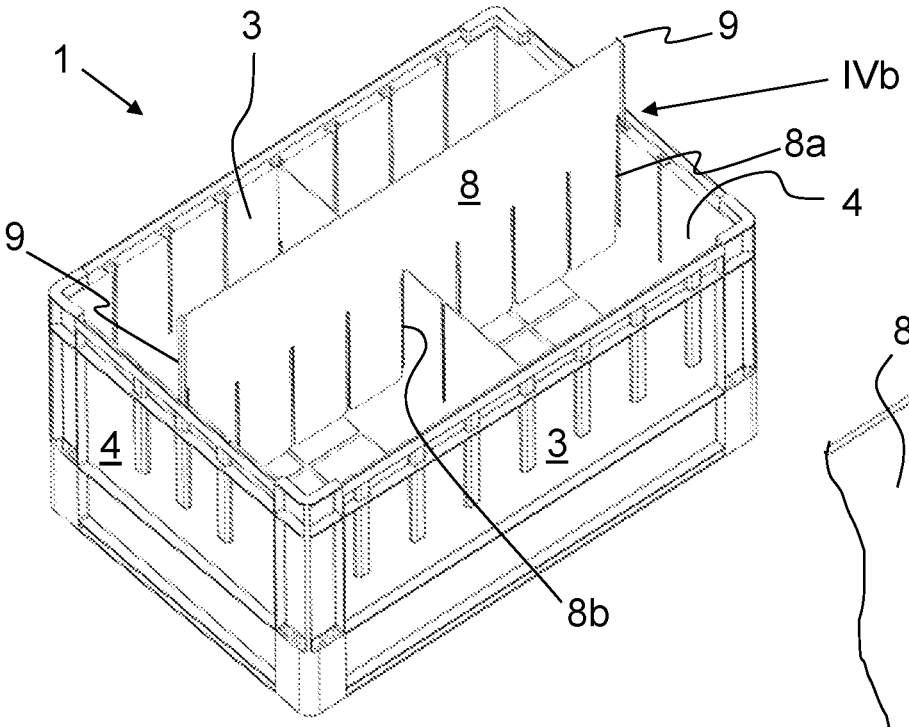
FIG. 4*a* shows the container of FIG. 3 with another partially inserted separating wall, perpendicular to the first separating wall.
Figure 5:
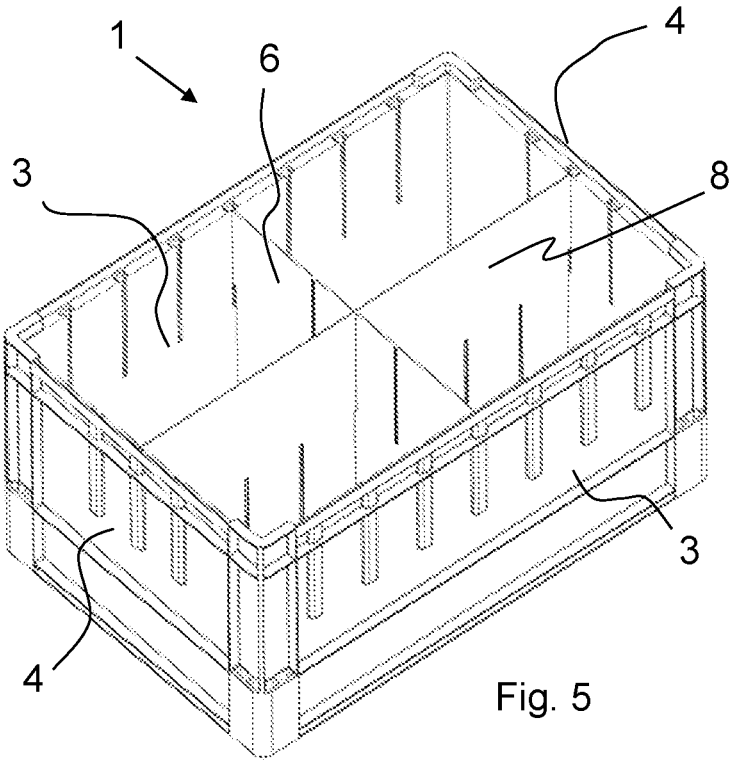
FIG. 5 shows the container of FIG. 4*a* with the separating walls fully inserted.

FIGS. 4*a* and *b* and 5 show the container 1 with a second separating wall 8 which can be inserted into the container 1 parallel to the long lateral wall 3 and at a right angle to the first separating wall 6. On the lateral edges 8*a* of the separating wall 8, same as on the separating wall 6, there are also protruding contours 9 which are form-fittingly inserted into the grooves 5 in the lateral walls 4 until they reach the base 2, as shown in FIG. 5. For this purpose, the separating wall 8 has slots 8*b* which are inserted into corresponding slots in the separating wall 6.

Figure 4B:
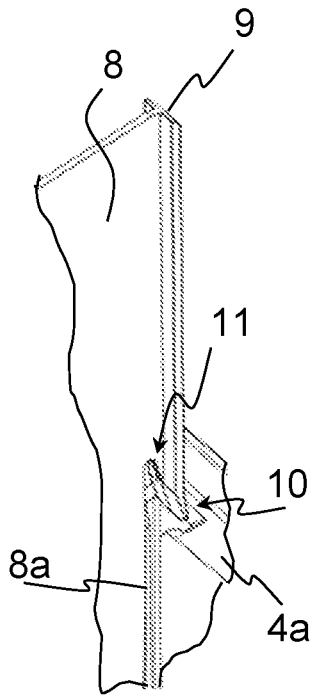
FIG. 4*b* shows the detail of the container of FIG. 4*a* marked with arrow IVb, in particular the shape of the protruding contour on the separating wall and a protrusion with a finger shape according to the invention during insertion into a groove of the lateral wall.

FIGS. 4*a* and 4*b* show the protrusion with the finger shape 10 according to the invention at the lower end of the protruding contour 9 on the separating wall 8 during insertion into the upper end of the groove 5 at the upper edge 4*a* of the lateral wall 4. A protrusion 10 according to the invention extends obliquely outwards at an angle from the plane of the lateral edge 8*a* of the separating wall 8. The angled shape provides the protrusion with an elastic property. Moreover, the protruding T-shaped contours 9 of the separating wall each have a recess 11 extending upwardly towards the upper edge of the separating wall 8.

The oblique, angled shape of the protrusion 10 enables the elastic property that enables the separating wall to be inserted into the groove 5, in particular repeatedly. In this case, the recess 11 in the protruding contour 9 further enhances this elastic property.

It is understood that the separating wall 6, which can be perpendicular to the separating wall 8, has the same properties and contours as the separating wall 8.

Figure 6A:
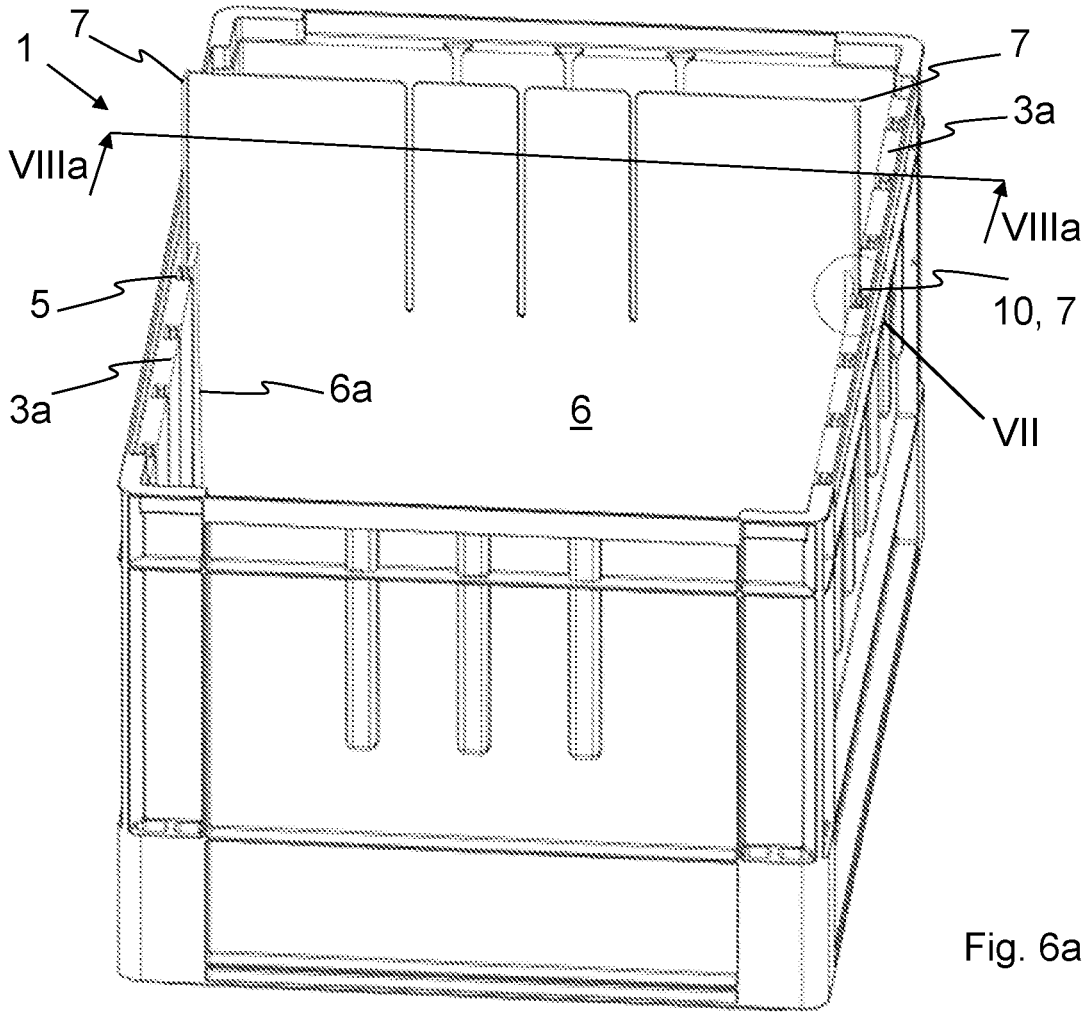
FIG. 6*a* shows another view of the container of FIG. 5 with a separating wall and the separating wall according to the invention during the insertion into the groove.

FIGS. 6*a* shows the container 1 with the separating wall 6 and protruding contour 7 of the separating wall 6 in a perspective view. The protruding contour 7 with a T-shaped cross-section has the protrusion 10 according to the invention obliquely leading away from the lateral edge 6*a* at an angle.

Figure 6B:
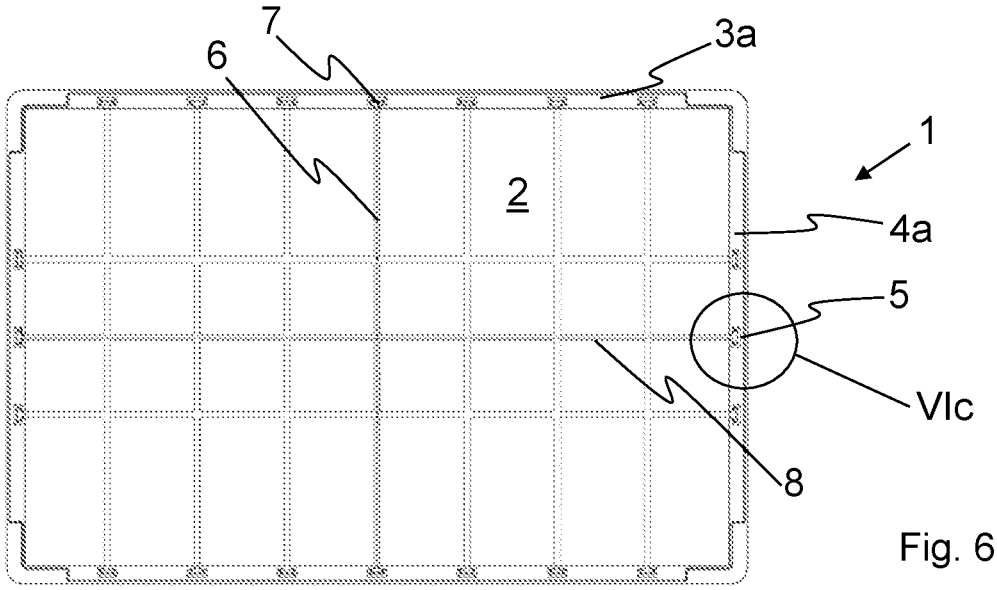
FIG. 6*b* shows a top view of the container of FIG. 6*a* with the two separating walls.
Figure 6C:
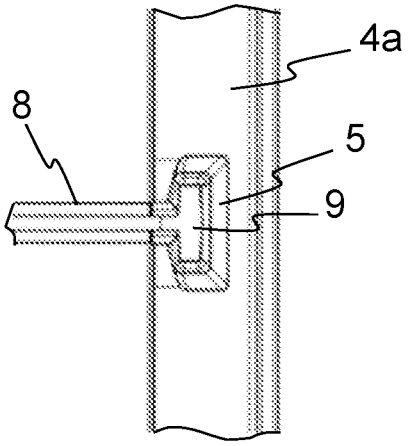
FIG. 6*c* shows the detail VIc of FIG. 6*b* and in particular the form-fitting connection of the contour of the separating wall with the groove in the lateral wall.

FIG. 6*b* shows the container 1 as a whole in a top view with the separating walls 6 and 8 and the protruding contours 7 and 9 as they fit in a form-fitting manner into the grooves 5 of the lateral wall 3 and 4, respectively, of the container. FIG. 6*c* shows in detail and in a top view of the upper edge 4*a* of the lateral wall 4 and the protruding T-shaped contour 9 of the separating wall 8 as it fits form-fittingly into the groove 5 with corresponding undercut.

The protrusion 10 leading away at an angle in FIG. 6*a* makes it possible that the contour 7 of the separating wall 3 can also be inserted into the groove of a lateral wall which is curved outwards in its upper region and is thus further away from the opposite lateral wall. The protrusion 10 on each lateral edge 3*a* of the separating wall in itself extends the extent of the separating wall so that it can more easily reach the grooves 5 of a lateral wall which is curved outwards in its upper region.

During the insertion of the separating wall downwards towards the base, the protrusion 10 is pushed inwards by the vertical wall of the groove 5 where it is elastically brought into the vertical position. This is possible due to its oblique and angled shape. In curved containers, the upper regions of the lateral walls are often curved outwards and the lower regions inwards towards the base. The elastic protrusions yield upon insertion into the grooves so that inserting the separating walls is possible even in the case of inwardly curved lateral walls.

Figure 7:
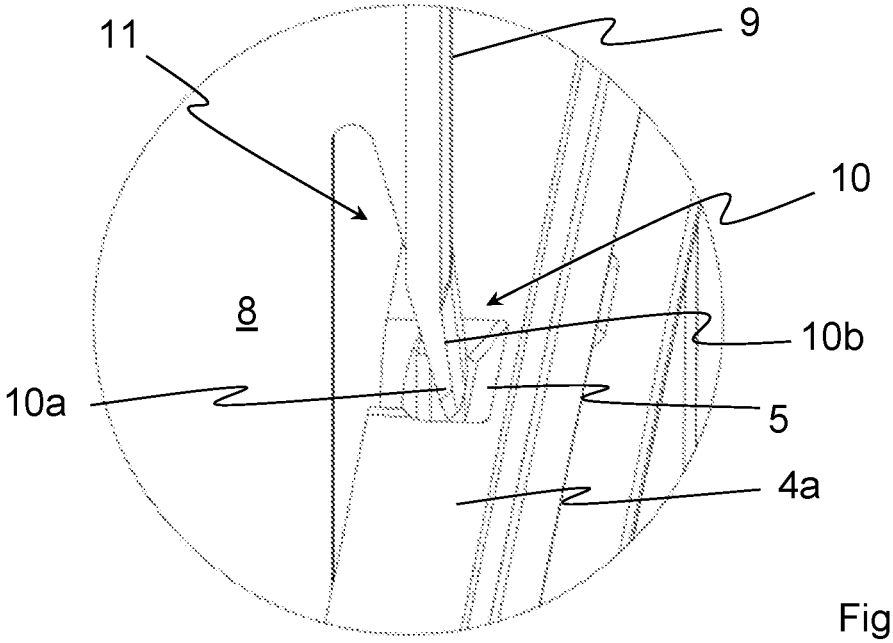
FIG. 7 shows a detail of the container according to the invention according to VII in FIG. 6, in particular the contour pointing obliquely away from the separating wall during insertion into the groove.

FIG. 7 shows in detail the finger shape of the protrusion 10 of the separating wall 6 in FIG. 6*a*. The angled protrusion 10 has an inner side 10*a* and an outer side 10*b*. FIG. 7 shows how the protrusion 10 protrudes outwards beyond the outer side of the protruding contour 7 and engages the groove 5.

Figure 8A:
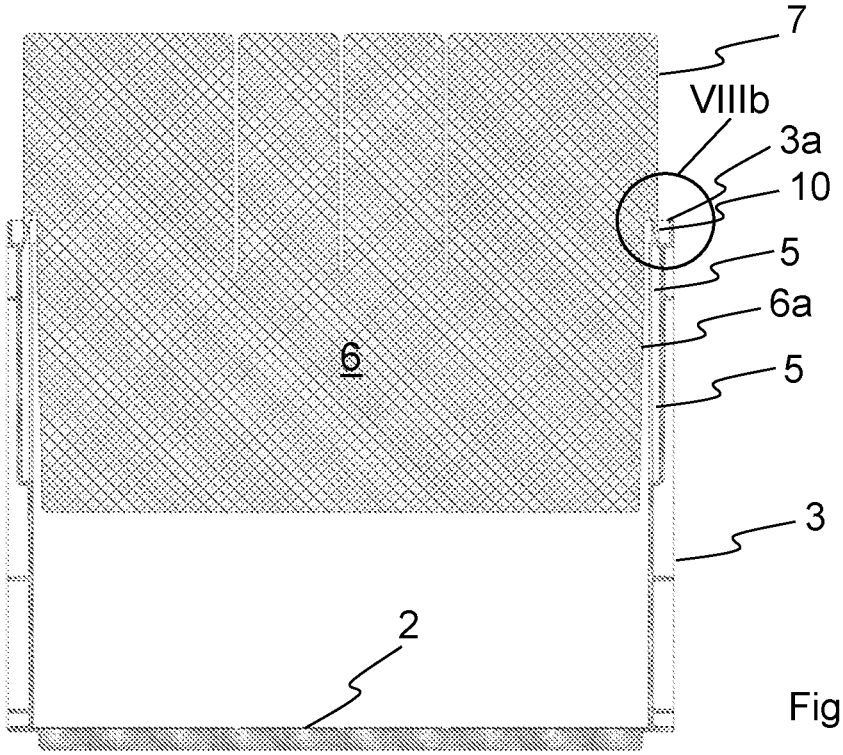
FIG. 8*a* shows the section through the container of FIG. 6*a* and the separating wall according to VIIIa-VIIIa in FIG. 6*a*.
Figure 8B:
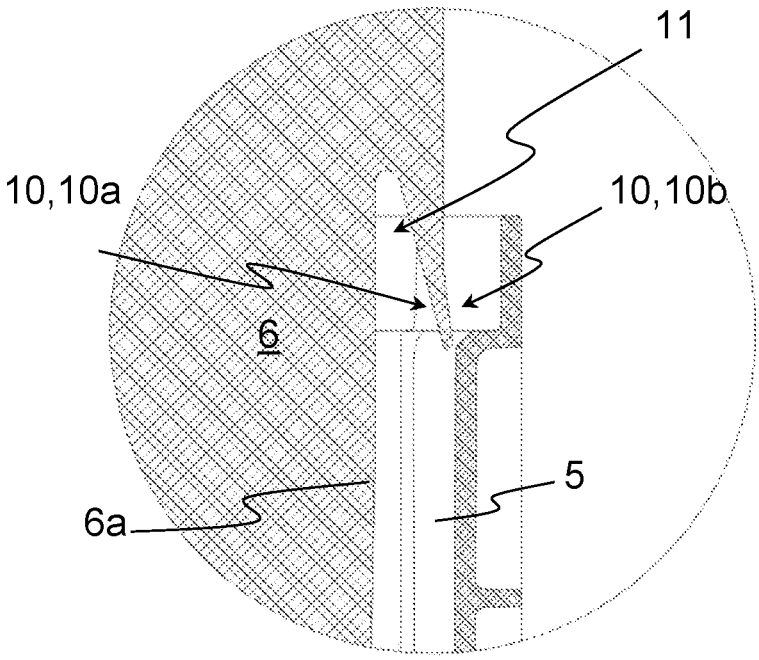
FIG. 8*b* shows the detail of the contoured separating wall according to the section VIIIb in FIG. 8*a*.
Figure 8C:
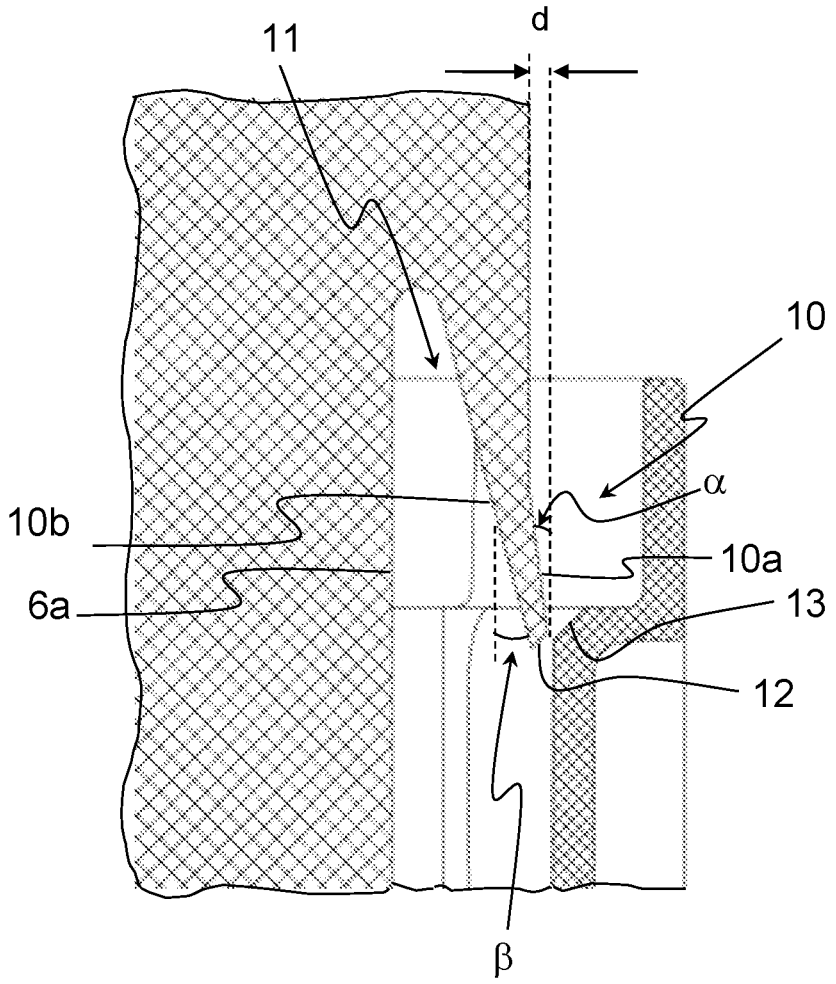
FIG. 8*c* shows the detail of the contour with protrusion of FIG. 8*b* in an enlarged view.

FIGS. 8*a, b* and *c* show the container 1 according to the invention in cross-section and in particular the separating wall 6 with protruding contour 7 and protrusion 10 as an installation aid. At its inner side 10*b*, the protrusion 10 extends away from the lateral wall at an angle β relative to the lateral edge 6*a* of the separating wall. At its outer side 10*b*, the protrusion extends away at an angle α relative to the lateral edge 6*a*. The outer angle α is smaller than the inner angle β. In the example shown, the inner angle β is 15° and the outer angle α is 10°. These angles result in a preferred elastic property for the function of the installation aid into the grooves. Other angles are possible depending on the material selection, shape and size of the protruding contour.

The recess 11 for enhancing the elastic property of the installation aid extends inwardly in the protruding contour 7 towards the lateral edge 6*a* and towards the upper edge of the separating wall 6.

To further simplify installation and prevent damage to the grooves and separating walls, the tip of the protrusion 10 is rounded or provided with a beveled end 12. Accordingly, the upper end of the groove 5 can also be provided with a beveled portion.

Although various embodiments of the present invention have been described and shown, the invention is not restricted thereto, but may also be embodied in other ways within the scope of the subject-matter defined in the following claims.

What is claimed is:

1. A container with a base and first and second lateral walls protruding perpendicularly upwards from the base, wherein the first lateral walls are opposite one another and the second lateral walls are opposite one another, and with one or more separating walls extending perpendicular to the base, wherein on their inner sides, the lateral walls have grooves which extend from their upper edge towards the base, and the one or more separating walls are each provided on both sides at their lateral edges with one contour which protrudes in each case from the lateral edge of the one or more separating walls and can be inserted from above into the grooves in a form-fitting connection, wherein an elastic protrusion is respectively disposed at a lowermost end of each of the protruding contours at the two lateral edges of the one or more separating walls, each elastic protrusion extending outwards and downwards away from the protruding contour at a predetermined angle to the lateral edge of the one or more separating walls and also shaped for insertion with the protruding contour into one of the grooves of the lateral walls from above to serve as an installation aid for inserting the lateral edge into the groove of the lateral wall;

wherein each of the elastic protrusions has an inner side directed towards the lateral edge and an outer side facing away from the lateral edge, wherein the elastic protrusion is pointed in that an inner angle (β) between the lateral edge and the inner side is greater than an outer angle (α) between the lateral edge and the outer side of the elastic protrusion; and wherein the protruding contours at the lateral edges of the separating walls are each T-shaped.

2. The container according to claim 1, wherein the protruding contours at the lateral edges of the one or more separating walls additionally have at their lower end a recess extending in the direction of the upper edge of the separating wall and extending above the elastic protrusions.

3. The container according to claim 1, wherein the inner angle (β) is 15° and the outer angle (α) is 10°.

4. The container according to claim 1 wherein the tip of the elastic protrusion is beveled or rounded.

5. The container according to claim 4, wherein the groove of the lateral wall includes a beveled portion at an upper end thereof for engaging the tip of the elastic protrusion.

6. The container according to claim 1 wherein the grooves in the lateral walls have an undercut on both sides.

7. The container according to claim 1, wherein a lowermost end of each elastic protrusion is disposed above a bottom edge of the separating wall.

8. The container according to claim 1, wherein, when the separating walls are inserted from above into the grooves, the elastic protrusions continuously contact the grooves from when the elastic protrusions first reach an upper end of the grooves until the separating walls reach the base.

9. The container according to claim 1, wherein the form-fitting connection during insertion of the separating walls is a contact fit until the separating walls reach the base.

10. The container according to claim 1, wherein the grooves of the lateral walls extend from uppermost edges of the lateral walls towards the base.

* * * * *